United States Patent [19]

Cesani et al.

[11] Patent Number: 4,677,402

[45] Date of Patent: Jun. 30, 1987

[54] PLURICAVITIES MICROWAVE FILTER HAVING CAVITIES ORIENTED IN A SAWTOOTH CONFIGURATION

[75] Inventors: Enrico Cesani, Milan; Andriano Forti, Vimercate, both of Italy

[73] Assignee: Telettra-Telefonia Elettronica e Radio S.p.A., Italy

[21] Appl. No.: 661,353

[22] Filed: Oct. 16, 1984

[30] Foreign Application Priority Data

Oct. 19, 1983 [IT] Italy ..... 23352 A/83

[51] Int. Cl.[4] ..... H01P 1/205

[52] U.S. Cl. ..... 333/203; 333/212; 333/230

[58] Field of Search ..... 333/208–212, 333/202, 203, 206, 222, 227, 230

[56] References Cited

U.S. PATENT DOCUMENTS 4,216,448 8/1980 Kasuga et al. ..... 333/212 X 4,291,288 9/1981 Young et al. ..... 333/212

FOREIGN PATENT DOCUMENTS 0197803 9/1976 Fed. Rep. of Germany ..... 333/206

OTHER PUBLICATIONS

Pfitzenmuier G.; "Linear Phase Microwave Bandpass Filter"; 1973 *European Microwave Conference*; vol. 1, Brussels Belgium; Sep. 4–7, 1973; 4 pages.

*Primary Examiner*—Eugene R. LaRoche

*Assistant Examiner*—Benny Lee

*Attorney, Agent, or Firm*—Ostrolenk, Faber, Gerb & Soffen

[57] ABSTRACT

A microwave filter which is optimized to reduce its dimensions, weight, cost, and manufacturabiity includes a filter body which is preferably manufactured by pressure die-casting of an aluminum alloy. In the filter body are formed a plurality of cavities in which resonators as well as tuning and connection screws are located. The cavities are so located with respect to each other that a line which joins the centers thereof appears as the series of connected line segments which are inclined with respect to each other at angles which exceed 90°. To compensate the filter for the relatively larger coefficient of expansion associated with the use of die-castable alloys, the resonators and tuning screws employ materials which are different than that used in the filter body. Electrical losses are minimized by varying, from cavity to cavity, the ratio of the diameter of the cavity to that of the resonator. The weight of the filter is further reduced by cavities or voids which are formed therein.

16 Claims, 10 Drawing Figures

PA.F
PA.C
AS7
AL'2
PAF
AL2
21
H
AL'1
IT
AL1
FPC'o
FPCo
AL4
AL'4
Go
VA1
G
A14
A13
A12
A11
A10
A9
A8
A7
A6
A5
A4
A3
A2
A1
AL7
AL6
AL5
AL3
AS6
VA5
VA3
AS4
AS2
VA1
AS1
VA2
VA4
AS3
VA6
AS5
AS7
C1
F
A
C
10

PLURICAVITIES MICROWAVE FILTER HAVING CAVITIES ORIENTED IN A SAWTOOTH CONFIGURATION

BACKGROUND OF THE INVENTION

The present invention is directd to a multi-cavity microwave filter which is optimized to reduce its overall dimensions, electric losses, weight, and manufacturing cost and which further has a simple but mechanically sturdy construction and which may be accurately reproduced.

As is well known, transmission apparatus require microwave filters suitable, in a Tx transmission mode, for eliminating all unwanted and secondary frequencies and for delivering a net signal for transmission. Similarly, at the receiving end, particularly in a Rx reception mode, the filter must filter out unwanted signals and provide an output comprised of useful signals only.

Filters which are used in both the Tx and Rx modes are generally identical to one another and have the same fundamental requirement that they must have very low attenuation characteristics within their passbands and a gradually increasing attenuation characteristic at frequencies which are outside the passband.

Conventionally, multi-cavity microwave filters are produced by employing - (1) a flanged waveguide pipe design - (2) cut or subpieces which are welded together and thereafter machined - (3) microwave filters which are produced from a full ingot. The conventional filters realized in the foregoing manner suffer from many drawbacks, which include: their inherent large sizes and attendant increased costs; complicated manufacturing; poor reproducibility; resistance to automatic machining in numerical control machines; etc.

SUMMARY OF THE INVENTION

It is an object of the present invention to provide a multi-cavity microwave filter which avoids the foregoing drawbacks.

It is a further object of the invention to provide microwave filters having a structure that yields smaller devices which can be manufactured by means of a very simple efficacious process which produces readily reproducible parts.

The foregoing and other objects are realized by a microwave filter having a generally parallelepiped-shaped metallic body and a plurality of resonant cavities formed in the metallic body. In each resonant cavity, there is provided a rod-shaped resonator and associated tuning and connection screws. This multi-cavity filter is characterized in that its cavities are so located with respect to one another that if a continuous line was drawn to join the centers of the cavities, the line would appear as a series of connected line segments. Moreover, and very significantly, the angle between every pair of line segments which meet at the center of a given cavity, is greater than 90°. The filter body has a length and a width. The cavities are parallel to one another and extend across the width of the filter body.

The cavities are interconnected by respective apertures or windows which are located along the segmented line. Preferably, the bottom of each cavity includes a through threaded hole that communicates with an external face located at the bottom of the filter body.

The filter body contains two opposite longitudinal faces in which, according to a preferred embodiment, there are provided two holes which communicate, respectively, with a first and a last cavity. Preferably, the external side of the two holes is spot-faced, meaning that they have the outward appearance of a net. Additionally, threaded dead holes, i.e. holes which do not extend from one side to an opposite side in the filter body, are formed in opposite faces of the filter body and also in parallel to its bottom.

According to a further preferred embodiment of the invention, the filter body in which the cavities, resonators and screws are provided, is fabricated by using a fully extruded rod that is subsequently cut and squared followed by milling, drilling, spot-facing, threading, boring, and stabilizing by heat treating thereof. Spot-facing of the body means that its faces are given an uneven finish.

A preferred method for fabricating the microwave filter in accordance with the invention is to manufacture the body by pressure die-casting of an aluminum alloy followed by a light flattening, i.e. straightening out, of its parallelepiped faces and then spot-facing of the holes formed along its vertical and transversal faces and completing the process by tumbling it. Tumbling refers to the surface-finishing process wherein small articles are tumbled in a barrel, along with sawdust and other polishing compounds. to remove irregularities or polish the small articles.

During the pressure die-casting of the filter body, the resonant cavities are formed with a light taper of about 2% and the weight of the filter body is reduced by forming voids or recesses in the solid parts thereof and by proportioning the thickness of its walls to be within the range of 2–4 millimeters. The recesses can be extended advantageously into through holes to further lighten the filter body.

Furthermore, to control electrical losses, the ratio of the diameters Dc of the various cavities to the diameters dr of their respective resonators vary from cavity to cavity. Preferably, the ratio is maximum at the cavity located at the center of the filter body and decreases for each cavity which is further away from the center.

The pressure die-casting fabrication method for the filter requires use of alloys having high flowability. To compensate the filter for the higher coefficients of expansion associated with such alloys, the tuning rods and screws comprise materials which have different coefficients of expansion from the alloy used in the filter body. This produces a filter with a range of frequency variation versus temperature that stays within a very restricted range.

Other features and advantages of the present invention will become apparent from the following description of preferrd embodiments of the invention and the accompanying drawings.

DETAILED DESCRIPTION OF THE PREFERRED EMBODIMENTS

Figure 1:
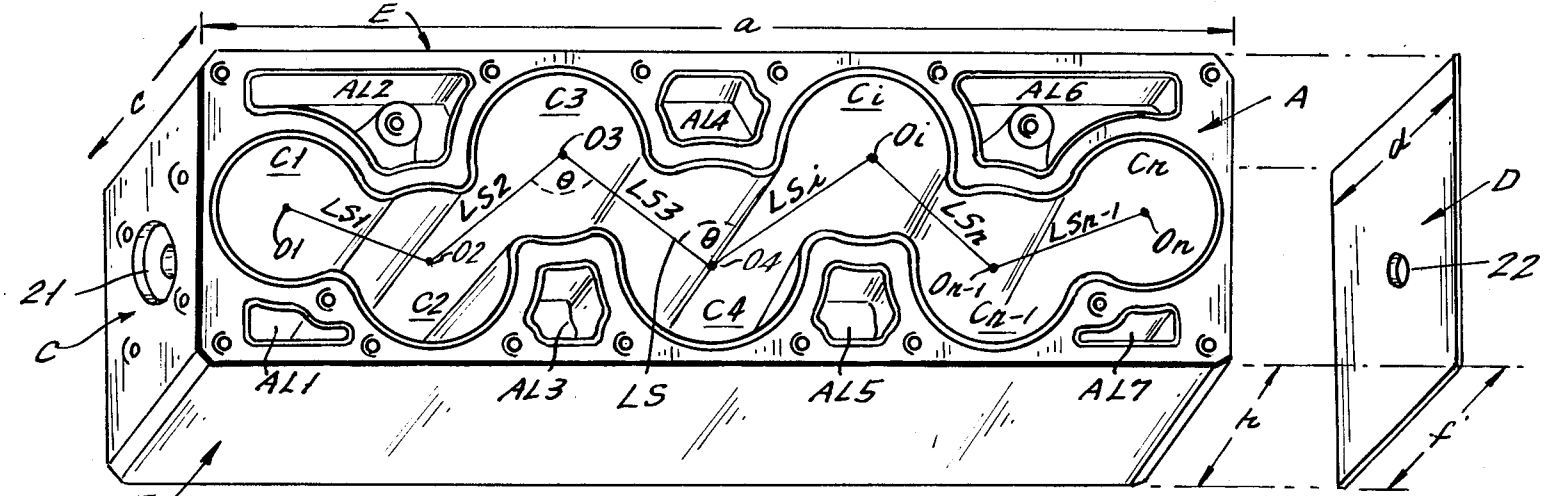
FIGS. 1 and 2 illustrate partially in schematic and partly in perspective views a first embodiment of the invention.

As illustrated schematically in FIG. 1, the filter in accordance with the present invention has six faces or three pairs of opposite faces. Only one face of each pair of faces is drawn in FIG. 1. The six faces include a top face A (FIG. 1) and a bottom face B (FIG. 2), two longitudinal faces F (FIG. 1) and E (FIG. 2), and two transverse faces C and D.

The filter includes "N" cavities which are labeled C1, C2 . . . Ci . . . Cn, each having a center labeled, respectively, as O1, O2 . . . Oi . . . On. The cavities Ci are so aligned in the filter that their centers may be viewed as being connected by a broken line LS which is comprised of N−1 line segments LS1, LS2 . . . LSi . . . LSn−1. The length of a given segment LSi is defined as length Li which comprises the distance between the centers Oi−1 and Oi and the angle $\sigma$ of a given segment is defined as the angle between line segments LSi and LSi+1.

Figure 3:
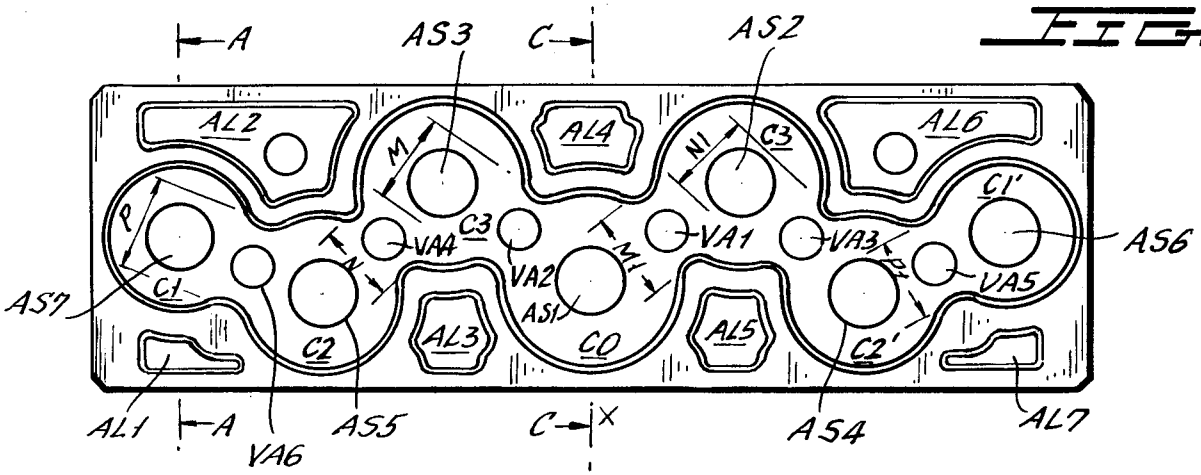
FIG. 3 is a plan view of the filter of the invention after it has been through its pressure die-casting stage.

Each cavity Ci communicates with its adjacent cavity Ci+1 through an aperture or a window which is shown and labeled in FIG. 3 as windows P,P1; N,N1; M,M1. It will be noted that in FIG. 3 seven cavities are drawn including a central cavity Co and three pairs of cavities C3, C3′; C2, about axis X in FIG. 3 which passes through the center of cavity Co. With respect to the previously referred to apertures or windows, it may be noted that apertures P and P1 are associated with cavities C1 and C1′; N and N1 are associated with C2 and C2′, etc.

Figures 4, 4A, 4B, 4C, 4D, 4E:
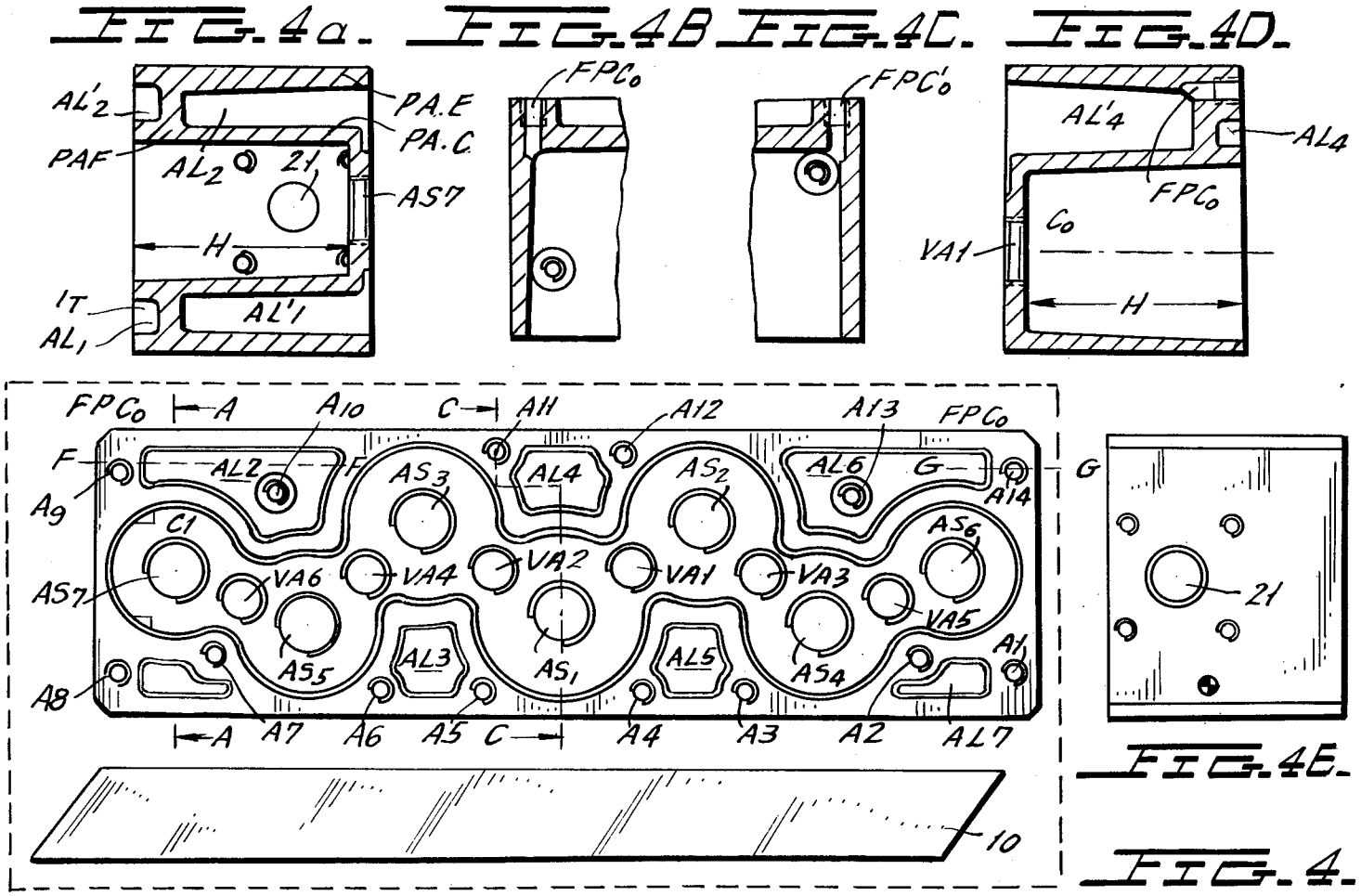
FIG. 4 shows the filter of FIG. 3 in its finished state.
FIGS. 4A–4D are lateral views, partially in cross-section, of the filters illustrated in FIGS. 4 and 5.
FIG. 4E is a front view of a transverse face of the filter illustrated in FIG. 4.

Each aperture extends along the entire depth of the cavity, depth being indicated by the letter H in FIGS. 4D and 1. Further, each aperture is placed with its central orthogonal axis oriented in a predetermined manner with respect to its respective segment of the broken line LS.

The transversely extending faces C and D, contain respectively a first hole 21 and a second hole 22. The first hole 21 penetrates into the first cavity C1 while the second hole 22 penetrates into the last cavity Cn. One of the holes, for example hole 21, has a step formed therein which faces outwardly. The hole is spot-faced.

Figure 2:
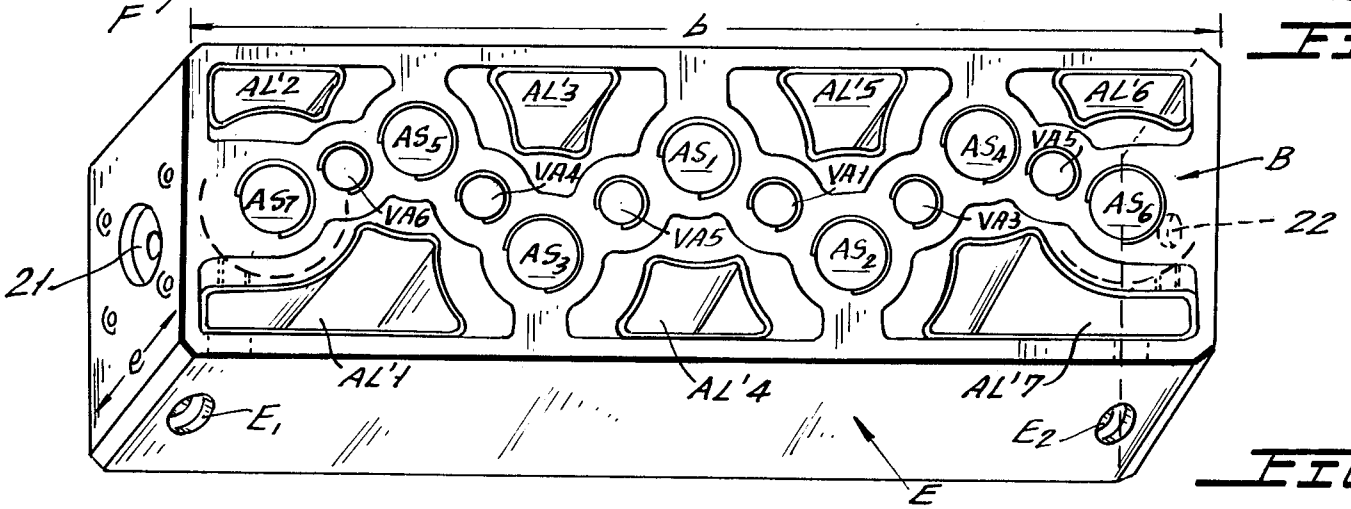

FIG. 2 also illustrates the filter shown in FIG. 1 except that the filter is rotated so that face E is located on the bottom and face B, which is not shown in FIG. 1, faces the reader. As shown in FIG. 2, face E contains two holes E1 and E2, which are spot-faced toward the outside and which communicate respectively with the first cavity C1 and the last cavity Cn. Face B, as illustrated in FIG. 2, contains a plurality of holes $As_1$–$A5_7$ which accommodate rod-shaped resonators and holes $VA_1$ to $VA_6$ which accommodate connection screws. Further, and as shown in FIG. 4, top face A contains n threaded holes $AS_1$–$AS_n$ which flank the entire cavity arrangement and which are used to secure therein a cover 10 for enclosing the cavities Ci.

In accordance with a further preferred embodiment of the invention, the distances between the cavities Ci, measured along line segments LSi, are arranged such that they are distributed in accordance with a symmetrical function about the central cavity. For example, LS1=LSn−1. LS2=LSn−2, LS3=LSn−3, etc.

The filter illustrated in FIGS. 1 and 2 can be easily manufactured by starting with a parallelepiped shaped metallic bar having three pairs of faces, namely faces A and B; C and D; and E and F. Face A measures "a" on each side, face B measures "b" on each side, and similarly the edge sizes of faces C, D, E and F are "c", "d", "e" and "f", respectively. Consequently, it follows that the areas of pair of faces are equal, A=B, C=D, E=F since a=b, c=d and e=f.

When the filter is fabricated from a solid bar, for example from an extruded bar of "ANTICORRODAL", (an alloy of Al, Mg and Si), the filter can be formed by cutting from the bar pieces having faces A, C and E, as noted above, and then squaring the pieces, machining them, for example by chip removal with machine tools, milling them, i.e. forming the cavities therein, tapping and trimming them. The filter thus formed may preferably be stabilized by treatment in an oven.

In accordance with another method for fabricating the filter of the present invention, it was found that the body having the dimensions A, C and E can, quite unexpectedly, yet with advantageous results, be produced as shown in FIG. 2 by pressure die-casting. It was found that this method was ideal for optimizing the dimension, weight, ease of construction, mechanical strength, cost and electrical losses of the device.

As has been previously noted, the dimensions of the filter are optimized by arranging the cavity such that they lie along the broken line LS which is deliberately set such that the angles $\sigma$ between the lines are greater than 90°. In fact, it is a deliberate objective of the present invention to avoid a cavity distribution which would follow a broken line arranged at about 90° because such a distribution, although it would have reduced the total length of the filter, would have unduly increased its width.

It was found that by distributing the cavities Ci in accordance with the present invention, the length of the final filter which is obtained produces a shortening of about 15% in comparison to cavities which would have been aligned along a right angle line, holding a width equivalent to $1\frac{1}{2}$ times the size of the same cavity.

With respect to electric losses, the present invention recognizes that greater losses are caused by the more centrally located cavities to those located nearer to the two transverse faces C and D. Accordingly, the ratio Dc/dr ("Dc" is the diameter of the cavity and "dr" is the diameter of the resonator) has been arranged such that Dc/dr varies from 3.33 to about 2.67 starting at the center cavity and progressing, symmetrically to the cavities located nearer the transversal sides C and D of the filter. Preferably, the values Dc/dr vary linearly from the center to the transverse sides.

Further, it is possible to keep diameter dr of the rods constant and to vary the value of the ratio Dc/dr, by varying the diameter Dc of the cavity to achieve the foregoing results. If the ratio Dc/dr would have been selected as a constant for all the cavities, for example the constant 3.33, the losses could also be avoided but that would have required increasing the filter length by about 10% to 15%.

Without adjusting the length of the filter, an attempt to provide a constant ratio of Dc/dr would have aggravated the electric losses in the device.

With respect to weight considerations of the filter, it was found advantageous to use an aluminum alloy (Silumin), with at least some traces of Si and other elements in it which would permit limiting the weight of the filter to about 335 grams of filter body or about 740 grams for the filter which includes connectors, resonator rods, adjustment screws and the cover 10. A similar filter which is fabricated from a solid rod which is machined to form the filter would have weighed 935 grams while a conventional similar filter would have weighed 1.9 kilograms.

It is the aluminum alloy which permits the filter to be fabricated by the pressure die-casting process. This process simplifies the construction of the filter significantly despite the complex structure of such filters.

In order to further reduce the weight of the fully-assembled filter, the thickness of the filter's walls is kept within the limits of 2–4 mm assuring that the outer filter shape has a regular form to facilitate the positioning of the filter in a working machine, such as a milling machine, etc., while at the same time obtaining an acceptably rigid structure.

To this end, the present invention provides that the various threaded holes in the filter penetrate entirely therethrough including the holes which are used for receiving screws which secure the cover of the filter to the filter body. It is impractical to provide such through holes using traditional fabrication methods and materials unless expensive machining procedures are employed.

It is important to note that the presence of holes in a solid body which do not penetrate from end to end pose a severe problem in the fabrication of such pieces whenever such pieces must be subjected to galvanic treatment. In the filter of the invention, galvanic treatment consists of a silvering process. Non-through-going holes present a problem in that they retain dressing bath acids used in the galvanic treatment which produce a corrosive effect in the device.

The use of an aluminum alloy, in particular "Silumin", was found particularly advantageous both from the consideration of cost and weight and further in view of the fact that it is one of the better materials for use in a pressure die-casting procedure, owing to its very high flowability index. Conventional wisdom in this art suggests to avoid this material primarily because of its high coefficient of expansion. Surprisingly, however, the conventional difficulty with this material was overcome by fabricating the resonator rods as well as the tuning and connection screws using materials of different coefficients of expansion, for example iron and copper alloys, in order to control the frequency response of the filter with respect to temperature. With the filter of the present invention, it has been possible to keep this variation to below 10 p.p.m./°C.

FIG. 2 provides a bottom view of the pressure die-casted filter and illustrates that the face B of the filter has a plurality of recesses AL1 . . . ALn therein which serve to reduce the weight of the filter. The Figure also shows the holes AS, which accommodate the resonator rods and the holes VA which accommodate the adjustment screws. As previously noted, the holes 21 and 22 on sides C and D of the filter support connectors for the filter.

Some of the previously recited critical aspects of the present invention are more clearly presented in FIG. 3. As shown therein, the filter includes a central cavity Co and three pairs of cavities, namely C1–C1′, C2–C2′ and C3–C3′ which are arrayed symmetrically with respect to the axis X—X. The diameters of the cavities in each pair are equal to each other but are unequal as compared to the diameters of any other cavity pair, including the central cavity Co.

Preferably, the diameter of the cavity Co is larger than that of the adjacent pair of cavities C3–C3′ whose diameter is correspondingly greater than the diameter of the next pair, namely C2–C2′, whose diameter, in turn, is larger than the diameters of the pair of cavities C1–C1′. Preferably, the diameters decrease linearly from the center toward the periphery.

A relationship similar to the relationship of the diameters also applies with respect to line segments LSi which extend between the centers of the adjacent cavities. Thus, it is advantageous that the length of pairs of line segments LSi associated with each pair of cavities also decrease linearly from the center cavity Co. It is preferable to provide a similar arrangement with respect to the aperture or windows which extend between the cavities.

Figure 5:
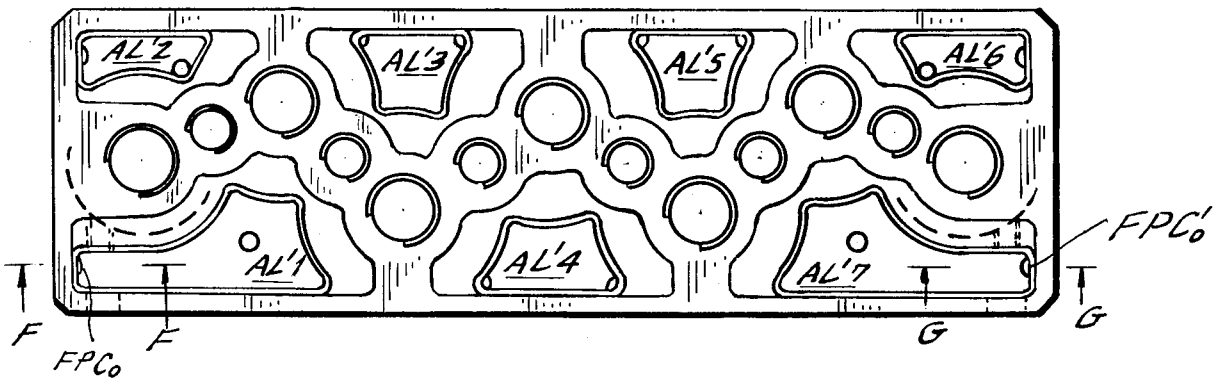
FIG. 5 is a bottom view of the finished filter of FIG. 4.

The preferred embodiment of the invention, for example as presented in FIG. 3, which illustrates the die-casted filter before the threaded holes are formed therein, or in FIG. 4 which provides the same filter but with the threaded holes therein, or in FIG. 5 which illustrates a bottom view of the completely assembled filter of FIG. 4, also contains the features that the diameters for the holes for the tuning rods pairs AS7-AS6, AS5-AS4 and AS3-AS2 are equal to one another and further that the diameters of the connection screws VA6-VA5, VA4-VA3 and VA2-VA1 are also equal to one another. A further advantage of the filter of the present invention which is produced by the pressure diecasting method resides in that it easily provides the means for reducing the weight of the filter by forming the recesses or voids AL1, AL2, AL3, AL4 . . . AL6 (FIGS. 3 and 4) on the top face thereof and also other recesses on the lower face thereof, as illustrated in FIG. 5.

FIG. 4A, which is a section through A—A of FIG. 4, illustrated that the lower recesses extend almost entirely through the height H of any given cavity, while the recesses AL1–AL6 on the top extend only over the shorter section h. The same figure also shows the thicknesses of the external wall PA.E, the cavity wall PA.C and the bottom wall PA.F. The thicknesses of all the walls are arranged to be within the narrow limit from 2–4 mm, so that this filter still remains very sturdy while its weight is reduced significantly.

FIG. 4B, which is a section F—F of FIG. 4 as well as FIG. 4C which is sectioned along G—G of FIG. 4, illustrates the advantages to be derived from providing throughholes, rather than bounded holes which are used in relation to the cover FPCo and FPCo′. FIG. 4D, which is a section along C—C of FIG. 4, is particularly instructive in that it shows in cross-section the structure of the central asymmetrical cavity Co and the associated recesses AL4 and AL4′ and also the threaded hole FPCo.

While the height H of all the cavities remains substantially constant, its diameter varies from about 30 mm at the central cavity Co to about 25 mm for the most remotely located pair of cavities C1–C1′.

As has been previously noted, the difference between the top views illustrated in FIGS. 3 and 4 is that FIG. 3 illustrates the filter in a non-finished state in which the holes AS7-AS1 for the resonators and the holes VA6-VA1 for the connection screws are not yet threaded while the filter illustrated in FIG. 4 shows the same holes after they have been threaded and also shows the threaded through-holes A1–A14 which are used for retaining the cover 10 on the filter.

FIG. 4E is a front view of the face C of the completed filter illustrated in FIG. 4 and provides the detail for the hole 21 which accommodates a connector and further shows that the hole 21 is spot-faced and includes a step as previously noted.

FIG. 5 provides a bottom view of the filter of FIG. 4 illustrating the strucutres and form of the recesses AL1', AL2', AL3', AL4' . . . AL7', which are used to reduce the weight of the filter and which are located on the lower face B. These recesses differ with respect to shape and depth from the other recesses designated AL1–AL7, which are provided in a top face A, a difference which is dictated by the necessity to compromise between obtaining maximum sturdiness and minimum weight.

A further feature of the present invention resides in that the holes 21 and 22 which accommodate the connectors, located on the transverse faces C and D, are not located on the same axis. Rather, they are located on different spaced longitudinal axes. This gives the filter a greater wiring and interconnecting versatility. Thus, it is possible to maintain constant the position of one side of the filter, for example the one where the hole 21 is provided while a connector which is located on the opposite face can assume a different position. Thus, the filter may be turned around its longitudinal axis passing for the center of the first connector in fixed position. The foregoing arrangement produces significant advantages, especially in the case where many filters must be installed substantially in parallel to one another. Thus, each of the filters will have one connector fixed in one orientation but the outer connector may be placed in a more convenient position by turning the filter around its longitudinal axis.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

We claim:

1. A microwave filter comprising:

an elongate parallelepiped shaped body having a length dimension and a pair of opposite faces extending transversely to said length dimension of said body;

a plurality of resonator cavities extending through a wall of and into said body, said cavities extending generally parallel to each other and transversely to said length dimension of said body, said cavities being arranged in accordance with a predetermined sequence which includes a first cavity located adjacent a first one of said transverse faces of said filter, a last cavity located adjacent said other transverse face of said filter and other cavities which are arranged in sequence between said first and last cavities along said length dimension, said cavities being so arranged that an imaginary continuous line which extends sequentially through a respective center of each of said cavities includes a plurality of line segments connecting adjacent cavities, such that said imaginary continuous line has a sawtooth appearance, the angle between adjacent line segments of said plurality of line segments being greater than 90°, said cavities being electromagnetically coupled to one another primarily along said imaginary continuous line;

a respective rod-shaped resonator located in the center of each cavity; and tuning and connection screws associated with said cavities.

2. The filter according to claim 1, further comprising a respective aperture located between every two most closely adjacent ones of said cavities, each said aperture extending transversely to said length dimension of said filter and having a length which is comparable to a length dimension of said cavities which is measured along the transverse direction of said body; each said aperture being shaped to provide a seat for a threaded hole for accommodating an adjustment screw therein.

3. The filter according to claim 2, wherein said filter comprises first and second generally parallel longitudinal faces which extend along said length dimension of said body, one of said longitudinal faces comprising a first hole therein for communicating with a first cavity located adjacent one of said transversal faces and a second hole communicating with a last cavity located adjacent the other of said transversal faces.

4. The filter according to claim 3, wherein said filter comprises a cover for covering said cavities and a plurality of threaded non-through holes for receiving bolts for fastening said cover to said body of said filter.

5. The filter according to claim 1, wherein said body of said filter is formed of an extruded rod which has been shaped into said filter body through a process which includes the sequential steps of cutting and squaring; milling, spot-facing, threading, burrowing and stabilization by heat treatment.

6. The filter according to claim 1, wherein said filter body is comprised of an aluminum alloy which is formed into said filter body through a pressure die-casting process.

7. The filter according to claim 6, wherein said cavities are formed with a light draft taper and, said filter body further includes a plurality of recesses formed in said filter body and serving to reduce the weight of said filter body without compromising a required structural rigidity in said filter body.

8. The filter according to claim 7, wherein said recesses in said filter body which are provided for reducing the weight thereof extend through said body.

9. The filter according to claims 5 or 6, wherein said cavities include a central cavity extending about the middle of said filter body and a plurality of cavity pairs which are arranged symmetrically with respect to said central cavity, each of the cavities of each cavity pair being spaced approximately equally from said central cavity, each of said cavities being cylindrically shaped and having a respective diameter Dc associated therewith, each one of said respective resonator being cylindrically shaped and having a diameter dr; the cavities and the resonators being so dimensioned that the ratio Dc/dr associated with each cavity is greatest at the central cavity, is about equal for each cavity pair and decreases for each cavity pair which is located further away from said central cavity.

10. The filter according to claim 9, wherein said ratios Dc/dr vary from about 3.5 to about 2.5.

11. The filter according to claim 10, wherein the diameter dr associated with said resonator rods is constant for all said resonators.

12. The filter according to claim 6, wherein said aluminum alloy of said filter body comprises a first coefficient of expansion and wherein said turning rods and screws associated with said filter are comprised of materials other than said aluminum alloy which materials comprise respective coefficients of expansion which are different from said coefficient of expansion of said aluminum alloy of said filter body, said other coefficients of expansion being selected for maintaining the range of frequency variation versus temperature of said filter within a predetermined limit.

13. The filter according to claim 12, wherein said aluminum alloy comprises an aluminum-silicium alloy which contains traces of iron and wherein said rods and screws are comprised of material selected from the group consisting of iron-lead and copperzinc alloys.

14. The filter according to claim 7, wherein said taper associated with said cavities is inclined at an angle of about 2° and wherein said filter comprises filter walls having thicknesses which range between 2–4 millimeters.

15. The filter according to claim 9, wherein the distance, measured along said imaginary line, from each one of said cavities to an adjacent one of said cavities located nearer said central cavity is equal for the cavities belonging to the same said cavity pair, said distance in each cavity pair being different from said distance in any other one of said cavity pairs.

16. The filter according to claim 1, further comprising a first input hole at one of said transversal faces for accommodating an input connector and an output hole for accommodating an output connector located on the other of said transversal faces, said input and output holes being offset from one another in the transversal dimension of said filter body, at least one of said input and output holes being offset from a longitudinal axis which extends along the length of said filter body whereby rotation of said filter body permits the adjustment of the distance between said offset input and output holes and a stationary reference located with respect to said filter body.

* * * * *